US007461929B2

(12) United States Patent
Sasaki

(10) Patent No.: US 7,461,929 B2
(45) Date of Patent: Dec. 9, 2008

(54) METHOD OF FILLING INK CARTRIDGE WITH INK

(75) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 329 days.

(21) Appl. No.: 11/159,294

(22) Filed: Jun. 23, 2005

(65) Prior Publication Data

US 2005/0285914 A1 Dec. 29, 2005

(30) Foreign Application Priority Data

Jun. 23, 2004 (JP) ..... 2004-184450

(51) Int. Cl.
*B41J 2/175* (2006.01)

(52) U.S. Cl. ..... 347/85

(58) Field of Classification Search ..... 347/85, 347/86, 87; 141/2, 18
See application file for complete search history.

(56) References Cited

U.S. PATENT DOCUMENTS 4,629,164 A * 12/1986 Sommerville ..... 239/69
4,968,998 A * 11/1990 Allen ..... 347/7
6,170,937 B1 * 1/2001 Childers et al. ..... 347/85
6,170,938 B1 1/2001 Kenyon
6,247,803 B1 * 6/2001 Kanaya et al. ..... 347/86
6,450,629 B2 * 9/2002 Childers ..... 347/85
6,520,630 B1 * 2/2003 Oda et al. ..... 347/85
6,565,197 B1 * 5/2003 Murray et al. ..... 347/85
6,634,738 B1 * 10/2003 Shinada et al. ..... 347/86
6,786,581 B1 9/2004 Shinada et al.
6,824,258 B2 * 11/2004 Yamamoto et al. ..... 347/86
7,004,564 B2 * 2/2006 Steinmetz et al. ..... 347/49
2002/0060725 A1 5/2002 Shinada et al.

(Continued)

FOREIGN PATENT DOCUMENTS

EP 0884187 A2 12/1998

(Continued)

OTHER PUBLICATIONS

Communication from the European Patent Office in corresponding European Patent Application No.: 05 012 921.2-2304, mailed Aug. 5, 2008.

*Primary Examiner*—Anh T. N. Vo
(74) *Attorney, Agent, or Firm*—Banner & Witcoff, Ltd.

(57) ABSTRACT

A method of filling an ink cartridge with ink, the ink cartridge being to be mounted on a main body of a recording apparatus and including: a casing in which is formed an ink chamber for accommodating ink; and at least one valve member which is disposed on one side of the casing and which is biased, in an ordinary state, in a direction to close at least one communication passage through which the ink chamber communicates with an exterior of the ink cartridge, the at least one valve member being arranged to be placed in an open state when the ink cartridge is mounted on the main body of the recording apparatus, the method including: forming, at a portion of the casing except for the one side thereof on which the valve member is disposed, an opening through which the ink chamber and the exterior of the ink cartridge communicate with each other; and filling the ink cartridge with ink by introducing the ink into the ink chamber through the opening.

16 Claims, 3 Drawing Sheets

U.S. PATENT DOCUMENTS

| | | | |
|---|---|---|---|
| 2004/0021751 | A1 | 2/2004 | Steinmetz et al. |
| 2004/0233260 | A1 | 11/2004 | Shinada et al. |

FOREIGN PATENT DOCUMENTS

| | | | |
|---|---|---|---|
| EP | 0940258 | | 9/1999 |
| EP | 1232870 | A1 | 8/2002 |
| EP | 1232871 | A1 | 8/2002 |
| JP | 2001113723 | | 4/2001 |
| JP | 2001180004 | | 7/2001 |

* cited by examiner

METHOD OF FILLING INK CARTRIDGE WITH INK

The present application is based on Japanese Patent Application No. 2004-184450 filed on Jun. 23, 2004, the contents of which are incorporated herein by reference.

BACKGROUND OF THE INVENTION

1. Field of the Invention

The present invention relates in general to a method of filling an ink cartridge with ink.

2. Discussion of Related Art

As disclosed in U.S. Pat. No. 6,786,581 B1, US 2002/060725 A1, and US 2004/233260 A1 corresponding to JP-A-2001-113723, an ink cartridge is installed on an ink-jet recording apparatus and ink in the ink cartridge is consumed in accordance with print operation performed by the ink-jet recording apparatus. When the ink in the ink cartridge is completely consumed, the ink cartridge which has been used is replaced with a new ink cartridge purchased by a user and the used ink cartridge is discarded. The discard of the used ink cartridge, however, undesirably results in environmental contamination and wasteful consumption of finite resources on the earth. Accordingly, there is a demand for recycling of the used ink cartridge. An ink cartridge disclosed in the above-indicated US documents is provided with a valve device which is kept in its closed state in an ordinary condition by means of a spring. When the ink cartridge is mounted on a recording apparatus, the valve device is placed in its open state, whereby ink in the ink cartridge is supplied to the recording apparatus. Where the ink in the ink cartridge is used up, the ink cartridge can be filled with ink through the valve device by placing the valve device in its open state. For placing the valve device in its open state with high reliability, however, it is required to use a jig suitable for the valve device.

SUMMARY OF THE INVENTION

The present invention has been developed in the light of the situations described above. It is therefore an object of the present invention to provide a method of easily filling an ink cartridge with ink.

The object indicated above may be achieved according to a principle of the invention, which provides a method of filling an ink cartridge with ink, the ink cartridge being to be mounted on a main body of a recording apparatus and including: a casing in which is formed an ink chamber for accommodating ink; and at least one valve member which is disposed on one side of the casing and which is biased, in an ordinary state, in a direction to close at least one communication passage through which the ink chamber communicates with an exterior of the ink cartridge, the at least one valve member being arranged to be placed in an open state when the ink cartridge is mounted on the main body of the recording apparatus, the method comprising: forming, at a portion of the casing except for the one side thereof on which the valve member is disposed, an opening through which the ink chamber and the exterior of the ink cartridge communicate with each other; and filling the ink cartridge with ink by introducing the ink into the ink chamber through the opening.

According to the present method described above which comprises a step of forming the opening that permits communication between the ink chamber and the exterior of the ink cartridge at a portion of the casing except for the one side thereof on which the valve member is disposed, the opening can be easily formed in the casing using a commercially available tool such as a drill, without being disturbed by the valve member, so that the ink can be introduced through the opening.

BRIEF DESCRIPTION OF THE DRAWINGS

The above and other objects, features, advantages and technical and industrial significance of the present invention will be better understood by reading a following detailed description of a preferred embodiment of the invention, when considered in connection with the accompanying drawings, in which.

DETAILED DESCRIPTION OF THE PREFERRED EMBODIMENT

Figure 1:
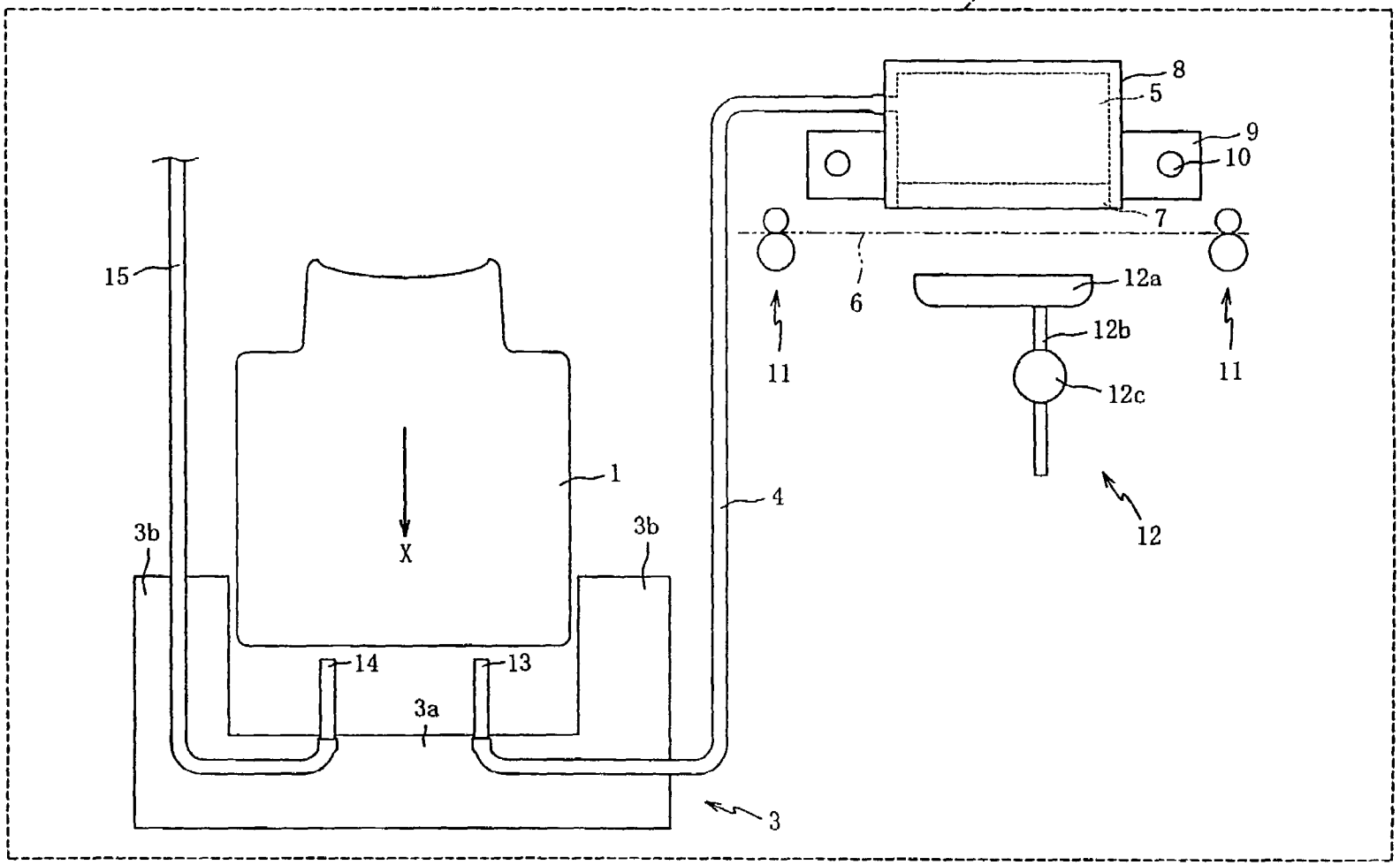
FIG. 1 is a schematic view showing an ink cartridge and an ink-jet recording apparatus on which the ink cartridge is mounted.

Referring to the drawings, there will be described a preferred embodiment of the present invention. Various aspects of the present invention may be used with the filling and/or refilling of an ink cartridge. FIG. 1 is a schematic view of an ink cartridge 1 and an ink-jet recording apparatus 2 on which the ink cartridge 1 is mounted.

The ink-jet recording apparatus 2 includes: a mounting portion 3 on which the ink cartridge 1 is removably mounted and which partially constitutes a main body of the recording apparatus 2; an ink tank 5 for storing ink to be supplied from the ink cartridge 1 via an ink supply tube 4; a recording head 7 for ejecting the ink stored in the ink tank 5 toward a recording medium 6; a carriage 9 by which is carried a head unit 8 including the ink tank 5 and the recording head 7 and which linearly reciprocates; a carriage shaft 10 which guides the reciprocating movement of the carriage 9; a sheet feeding mechanism 11 for feeding the recording medium 6; and a purging device 12.

The ink cartridge 1 is provided for each of a plurality of different colors of inks such as cyan, magenta, yellow, black, etc., and is mounted on the ink-jet recording apparatus 2 for enabling the recording apparatus 2 to perform color printing operation.

The mounting portion 3 includes a base portion 3*a* and guide portions 3*b*, 3*b* which extend from opposite ends of the base portion 3*a*. A hollow ink-supplying pipe 13 and a hollow air-introducing pipe 14 are disposed so as to protrude from the base portion 3*a* which is interposed between the guide portions 3*b*, 3*b*. The ink-supplying pipe 13 is for extracting the ink stored in the ink cartridge 1 and the air-introducing pipe 14 is for introducing air into an interior of the ink cartridge 1. Each of the ink-supplying pipe 13 and the air-introducing pipe 14 has, at a top end thereof, a generally flat surface. The ink-supplying pipe 13 and the air-introducing pipe 14 respectively have, at respective upper end portions thereof, communication openings 13*a* and communication openings 14*a* each in the form of a cutout.

The ink supply tube 4 is connected to one of opposite ends of the ink-supplying pipe 13, so that the ink-supplying pipe 13 communicates with the ink tank 5 via the ink supply tube 4. An air-introduce tube 15 is connected to one of opposite ends of the air-introducing pipe 14, so that the air-introducing pipe 14 communicates with outside air via the air-introduce tube 15.

The recording head 7 includes: a cavity plate (not shown) which is formed by superposing a plurality of plates and to which the ink is supplied from the ink tank 5; and a piezoelectric actuator plate (not shown) which has a plurality of piezoelectric deforming portions and which is formed to have a plate-type structure. The cavity plate and the piezoelectric actuator plate are bonded to each other so as to constitute the recording head 7. For ejecting the ink, a CPU (not shown) outputs drive signals to the respective piezoelectric deforming portions. The piezoelectric deforming portions into which the drive signals have been inputted deform, whereby the ink is jetted from nozzles (not shown) corresponding respectively to the deformed piezoelectric deforming portions. The nozzles are arranged in zigzag fashion on a surface of the recording head 7 that faces the recording medium 6.

The purging device 12 is located outside a recording area so as to be opposed to the recording head 7. The purging device 12 has a purge cap 12*a* for closing the surface of the recording head 7 in which the nozzles are formed, a waste-ink tube 12*b* which communicates with the purge cap 12*a*, and a pump 12*c* for sucking poor-quality or waste ink from the nozzles via the waste-ink tube 12*b*.

By referring next to FIG. 2, there will be explained a structure of the ink cartridge 1. The ink cartridge 1 has a casing in which is formed an ink chamber 20 that is a space for accommodating the ink. The casing is constituted by: a casing body 1*b* which gives a bottom wall 21 and a circumferential wall 22 of the ink chamber 20 and which has an upper opening; and a lid member 1*a* which closes the upper opening of the casing body 1*b*. To the thus constituted casing, a cover member 1*c* is fixed so as to clover the bottom wall 21 of the casing body 1*b*. The cover member 1*c* is formed with two end holes 23, 24 through which respective valve devices 27, 28 (that will be described) are exposed to the exterior of the ink cartridge 1 on the mounting-portion side. The lid member la and the cover member 1*c* are bonded or welded to the casing body 1*b*, thereby providing the ink cartridge 1. In the present embodiment, the lid member 1*a*, the casing body 1*b*, and the cover member 1*c* are formed of a resin material such as polypropylene, polystyrene, or polyacetal.

The bottom wall 21 is formed with an ink-supply hole 25 which is open for supplying the ink in the ink chamber 20 to the exterior. The ink-supply hole 25 is defined by interior space of a cylindrical wall 25*a* which is formed integrally with the bottom wall 21 so as to protrude from the lower surface of the same 21. The bottom wall 21 is further formed with an air-introduce hole 26 which is open for introducing the outside air into the ink chamber 20. The air-introduce hole 26 is defined by interior space of a cylindrical wall 26*a* which is formed integrally with the bottom wall 21 so as to protrude from the lower surface of the same 21. When the ink cartridge 1 is installed on the mounting portion 3, the ink-supplying pipe 13 is inserted into the ink-supply hole 25 while the air-introducing pipe 14 is inserted into the air-introduce hole 26.

Within the cylindrical wall 25*a* that defines the ink-supply hole 25, the valve device 27 is disposed so as to inhibit communication between the interior and the exterior of the ink cartridge 1. Within the cylindrical wall 26*a* that defines the air-introduce hole 26, the valve device 28 is disposed so as to inhibit communication between the interior and the exterior of the ink cartridge 1. The valve devices 27, 28 will be explained in greater detail.

The bottom wall 21 is formed with a plurality of communication holes 30 through which the ink-supply hole 25 and the ink chamber 20 communicate with each other. At a central position surrounded by the plurality of communication holes 30, there is formed a through-hole 31 in which is inserted a check valve 32 having a generally umbrella-like shape. The check valve 32 is formed of an elastic resin material having elasticity.

Figure 2:
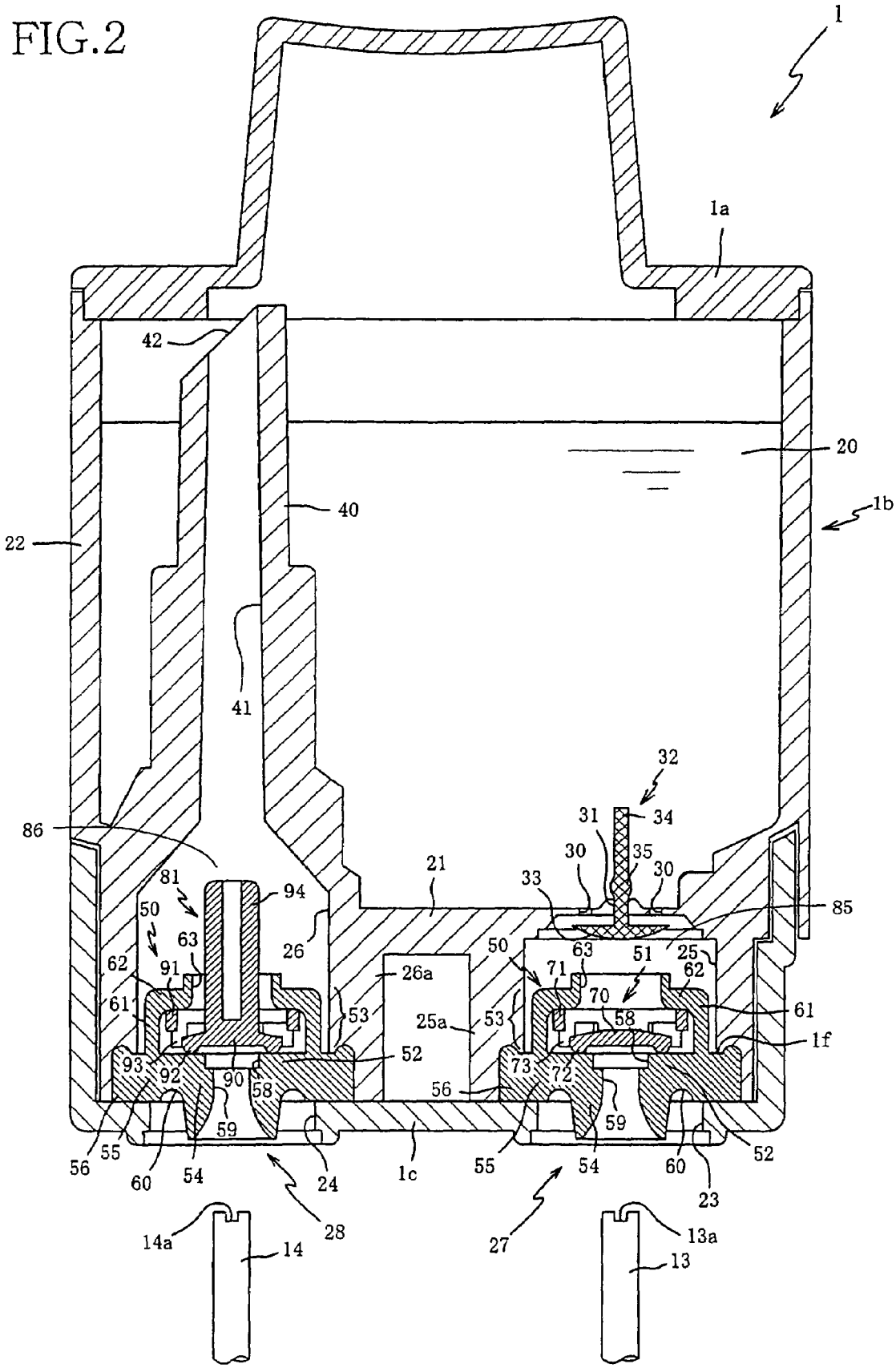
FIG. 2 is a cross sectional view of the ink cartridge.

As shown in FIG. 2, the check valve 32 consists of a disc-like portion 33 having elasticity and located on one of opposite sides of the bottom wall 21 nearer to the ink-supply hole 25 so as to oppose to the bottom wall 21; and a shaft portion 34 which extends from a substantially central part of the disc-like portion 33 toward the ink chamber 20 through the through-hole 31. The shaft portion 34 includes a ball portion 35 which has a generally ball-like shape and whose diameter is larger than an inside diameter of the through-hole 31. The shaft portion 34 is supported in the through-hole 31 so as to be slidable between a position at which the movement of the shaft portion 34 is stopped by the disc-like portion 33 and a position at which the movement of the shaft portion 34 is stopped by the ball portion 35.

On the bottom wall 21, there is formed a hollow cylindrical air-introduce member 40 which extends from the bottom wall 21 in an upward direction toward the upper opening of the casing body 1*b* and which is formed integrally with the bottom wall 21. The air-introduce member 40 has an upper end opening 42 that is open above the surface of the ink in the ink chamber 20. The air-introduce member 40 communicates at its lower end portion with the air-introduce hole 26 and has an inner flow passage 41 through which the air is introduced into the ink chamber 20.

Next, there will be explained the valve device 27 disposed in the ink-supply hole 25 and the valve device 28 disposed in the air-introduce hole 26. The valve device 27 includes: a support member 50 which is an integral body provided by a rubber-like elastic member; and a valve member 51 formed of a resin material. The support member 50 has a generally cylindrical outer profile and is integrally constituted by including: a valve seat portion 52 which is located at a substantially middle portion of the support member 50 as seen in its center axis direction; a bias portion 53 which is located on one of opposite sides of the valve seat portion 52 nearer to the ink chamber 20; a cylindrical portion 54 which extends from the valve seat portion 52 so as to be located on the other of the opposite sides of the valve seat portion 52 remote from the ink chamber 20; and an outer cylindrical wall 55 which is located radially outwardly of the cylindrical portion 54 with a spacing therebetween and which extends in parallel with the cylindrical portion 54. The valve member 51 is accommodated within the bias portion 53 while being biased by the same 53 in a direction in which the valve member 51 abuts on the valve seat portion 52.

The outer cylindrical wall 55 has a positioning portion 56 which protrude therefrom in a radially outward direction. The ink-supply hole 25 has, at its open end, a large-diameter portion If having a diameter larger than the other portion (small-diameter portion) thereof, for accommodating the positioning portion 56. With the positioning portion 56 pressed and gripped by an between the large-diameter portion if and the cover member 1*c*, the casing body 1*b* and the cover member 1*c* are bonded or welded together, thereby preventing the ink from leaking from between the casing body 1*b* and the valve device 27.

The valve seat portion 52 has an opening 58 formed at its central portion through the thickness thereof in its center axis direction. The cylindrical portion 54 has a guide passage 59 into which the ink-supplying pipe 13 is inserted when the ink cartridge 1 is mounted on the mounting portion 3. The cylindrical portion 54 is formed integrally with and adjacent to the valve seat portion 52 with the guide passage 59 held in communication with the opening 58. The guide passage 59 is arranged to have an inside diameter smaller than an outside diameter of the ink-supplying pipe 13 for permitting the ink-supplying pipe 13 inserted thereinto to be brought into close contact with the inner wall of the cylindrical portion 54 defining the guide passage 59. The opening 58 has a size which is larger than the inside diameter of the guide passage 59 and the outside diameter of the ink-supplying pipe 13. The inside diameter of the guide passage 59 gradually increases, at one end thereof nearer to the exterior of the ink cartridge 1, in a direction away from the opening 58.

The cylindrical portion 54 and the outer cylindrical wall 55 are spaced apart from each other by an annular groove 60, and the cylindrical portion 54 is arranged to be elastically deformed in a plane perpendicular to the center axis direction of the guide passage 59. The bias portion 53 is constituted by including: a cylindrical side wall portion 61 which extends from the periphery of the valve seat portion 52 toward the ink chamber 20; and an inwardly-extending portion 62 which is formed adjacent to the cylindrical side wall portion 61 and which extends radially inwardly so as to abut on one end of a cylindrical valve wall 71 of the valve member 51 (which will be described), which one end is located nearer to the ink chamber 20. The inwardly-extending portion 62 has a central opening 63 formed at its central portion. The bias portion 53 biases, by elasticity of the cylindrical side wall portion 61 and the inwardly-extending portion 62, the valve member 51 in a direction in which the valve member 51 abuts on the valve seat portion 52. In an ordinary state, the bias portion 53 biases the valve member 51 such that the valve member 51 is held in close contact with the valve seat portion 52. When the valve member 51 is pushed up toward the ink chamber 20 upon insertion of the ink-supplying pipe 13 into the guide passage 59, the cylindrical side wall portion 61 is stretched and the inwardly-extending portion 62 is inclined, to thereby form a clearance between the valve member 51 and the valve seat portion 52 for an ink flow.

The valve member 51 has a bottom portion 70 which abuts on the valve seat portion 52 of the support member 50 and the cylindrical valve wall 71 which extends from the periphery of the bottom portion 70 toward the ink chamber 20. The bottom portion 70 has, on one of its opposite surfaces which faces the valve seat portion 52, an annular protruding portion 72 which protrudes toward the valve seat portion 52 and which is formed at a position located radially inwardly of the cylindrical valve wall and radially outwardly of the guide passage 59. In a state in which the valve member 51 is accommodated within the support member 50, the cylindrical valve wall 71 of the valve member 51 is held in close contact with and pressed against the lower surface of the inwardly-extending portion 62 of the bias portion 53, whereby the annular protruding portion 72 of the valve member 51 closely contacts the upper surface of the valve seat portion 52 by elastically deforming the same 52. Thus, the guide passage 59 is fluid-tightly closed with respect to the ink chamber 20.

A plurality of communication passages 73 are formed such that each communication passage 73 is located radially outwardly of the protruding portion 72 of the bottom portion 70 and extends into the cylindrical valve wall 71. Through the communication passages 73, the upper portion of the valve member 51 nearer to the ink chamber 20 and the lower portion thereof remote from the ink chamber 20 communicate with each other. The communication passages 73 are formed so as to be spaced apart from each other with a constant spacing distance in the circumferential direction of the bottom portion 70.

The valve device 28 is substantially identical in construction with the valve device 27. The same reference numerals used for the components of the valve device 27 are used to identify the corresponding components of the valve device 28 and a detailed explanation of which is dispensed with. The valve device 28 has a valve member 81 which includes: a bottom portion 90, a cylindrical valve wall 91, an annular protruding portion 92, and communication passage 93, which are similar to the corresponding components of the valve member 51. The valve device 28 further has a projecting portion 94 which is formed at a generally central portion of the upper surface of the bottom portion 90 and which projects toward the ink chamber 20 farther than the cylindrical valve wall 91. The projecting portion 94 is inserted through the opening 63 of the bias portion 53 with a spacing interposed therebetween and projects toward the air-introduce member 40.

When the ink cartridge 1 is mounted on the mounting portion 3 (in a direction indicated by an arrow "X" in FIG. 1), the ink-supplying pipe 13 and the air-introducing pipe 14 are inserted into the respective guide passages 59 while deforming the respective cylindrical portions 54 such that the diameter thereof increases, and the two pipes 13, 14 are brought into abutting contact respectively with the bottom portion 70, 90 of the valve member 51 and the valve member 81. Thereafter, when the ink cartridge 1 is further pushed in the above-indicated X-direction, the valve members 51, 81 are pushed toward the ink chamber 20 (i.e., moved in a direction away from the respective valve seat portions 52), so that there are formed an air-introduce passage 86 in the valve device 28 for introducing the air into the interior of the ink cartridge 1 and an ink-supply passage 85 in the valve device 27 for supplying the ink from the ink cartridge 1 to the exterior thereof. The ink cartridge 1 is packed such that the interior thereof is kept under reduced pressure. Accordingly, where the air-introduce passage 86 and the ink-supply passage 85 are formed at substantially the same time, the air tends to flow from the air-introducing pipe 14 toward the ink chamber 20 and the ink remaining in a flow passage between the ink-supplying pipe 13 and the recording head 7 tends to flow from the ink-supplying pipe 13 toward the ink chamber 20. However, the check valve 32 inhibits the remaining ink from flowing back into the ink chamber 20, and the air rapidly flows into the upper portion of the ink chamber 20 from the air-introducing pipe 14 via the inner flow passage 41 of the air-introduce member 40.

In an ordinary state, the check valve 32 is placed, by its self-weight, in a position where the disc-like portion 33 is spaced apart from the communication holes 30, whereby the ink is supplied from the ink chamber 20 to the recording head 7 via the communication holes 30, the communication passages 73 of the valve member 51, and the ink-supplying pipe 13. As the ink flows out of the ink chamber 20, the air is supplied to the upper portion of the ink chamber 20 from the air-introducing pipe 14 via the inner flow passage 41 of the air-introduce member 40. In this instance, the upper end of the projecting portion 94 of the valve device 28 disposed within the air-introduce hole 26 is positioned such that it is spaced apart from the lower end of the inner flow passage 41, so as to assure the air-flow toward the ink chamber 20.

In a case where the ink stored in the ink chamber 20 of the ink cartridge 1 is consumed by printing operation, it is desirable to fill the ink cartridge 1 with ink.

Figures 3A, 3B, 3C:
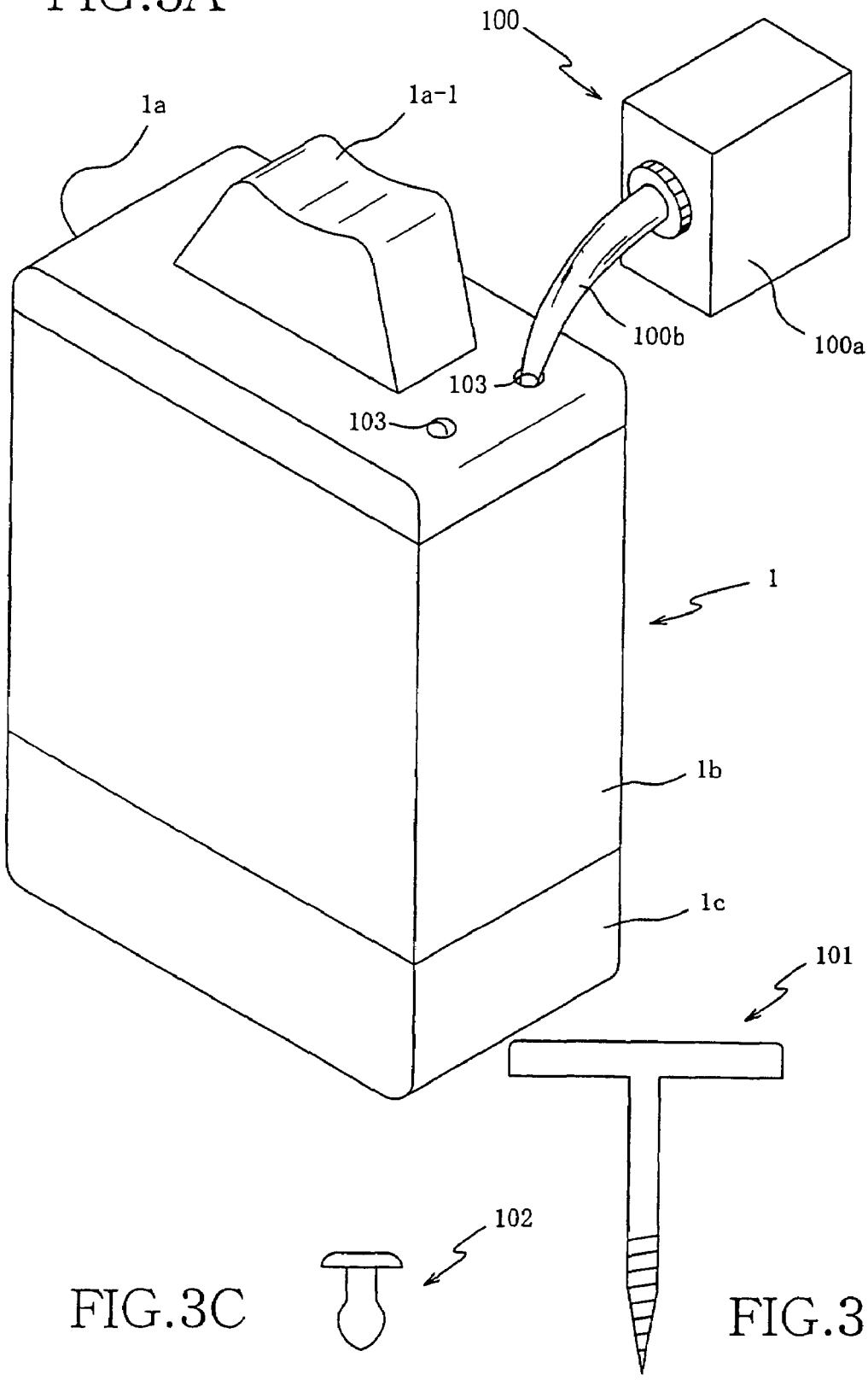
FIG. 3 is a view for explaining a method of filling the ink cartridge with ink according to the present invention.

The ink cartridge 1 is filled with the ink in the following method: As shown in FIG. 3A, an opening 103 for permitting communication between the ink chamber 20 and the exterior is formed in the casing which constitutes the ink chamber 20, and the ink is introduced into the ink chamber 20 through the opening 103 using an ink-injector 100. The opening 103 is formed preferably at a portion of the lid member la or a portion of the circumferential wall 22 of the casing body 1*b*, except for the cover member 1*c* fixed to one side of the casing for holding the valve devices 27, 28. It is particularly preferable to form the opening 103 in the upper surface of the lid member 1*a* except for a gripping protrusion 1*a*-1 thereof since that upper surface is flat. The reasons because it is not preferable to form the opening 103 in the cover member 1*c* are as follows: It is difficult to form the opening 103 in the cover member 1*c* since the valve devices 27, 28 and the walls for accommodating the same 27, 28 are present in the cover member 1*c*. Further, the formation of the opening 103 in the cover member 1*c* may cause a risk of breaking or destroying the valve devices 27, 28.

The ink-injector 100 includes a container portion 100*a* formed of a flexible material and accommodating the ink and a tube-like nozzle portion 100*b* extending form the container portion 100*a*. The nozzle portion 100*b* has, at its leading end, an outside diameter that is equal to or smaller than an inside diameter of the opening 103 formed in the casing. The nozzle portion 100*b* is inserted into the opening 103 and the container portion 100*a* is compressed, whereby the ink in the container portion 100*a* is introduced into the ink chamber 20. There may be employed, as the container portion 100*a*, a syringe-like device constituted by a cylinder and a piston.

The opening 103 is formed using a commercially available tool such as a drill 101 shown in FIG. 3B. Preferably, as shown in FIG. 3A, two openings 103 are formed, and the ink is introduced through one of the two openings 103 while the air in the ink chamber 20 is discharged through the other of the two openings 103, so that the ink cartridge 1 can be efficiently and quickly filled with the ink. The resin material for the ink chamber 20 is transparent or translucent. Accordingly, the introduction of the ink into the ink chamber 20 can be performed while visually checking the amount of the ink introduced into the ink chamber 20, and the introduction of the ink is stopped before the surface level of the ink in the ink chamber 20 reaches a level of the upper end opening 42 of the air-introduce member 40.

After the ink cartridge 1 has been filled with the ink, the opening 103 is fluid-tightly closed by fitting, in the opening 103, a plug 102 having a shape as shown in FIG. 3C. The plug 102 is formed of an elastic body such as rubber, and has a shaft portion and end portions which are respectively formed at opposite ends of the shaft portion and which have respective diameters that are larger than the diameter of the opening 103. The plug 102 is closely fitted in the opening 103 and the end portions thereof are brought into close contact with opposite surfaces of a wall which constitutes the casing, whereby the opening 103 can be completely and easily closed. The opening 103 may be fluid-tightly closed using an adhesive tape, a seal tape, or the like. The opening 103 is fluid-tightly closed to prevent: a change in the concentration of the ink due to evaporation of the aqueous component in the ink; ink-ejection failure due to entering of foreign matter; and leakage of the ink from the ink cartridge 1 during carrying of the same 1.

As described above, according to the present method of filling the ink cartridge with the ink, the opening 103 is formed in the casing except for the cover member 1*c* which is fixed to the one side of the casing of the ink cartridge 1 and the ink is introduced through the opening 103. As compared with the above-described conventional arrangement in which the valve member is placed in its open state and the ink is introduced via the valve member, the present method assures simplified operation of filling the ink cartridge with the ink and does not require any jig exclusive for the ink cartridge. Aspects of the present invention may be used with at least one of filling an ink cartridge for a first time or refilling the ink cartridge after its ink supply has been at least partially used.

It is to be understood that the invention is not limited to the details of the illustrated embodiment, but may be embodied with various changes and modifications, which may occur to those skilled in the art, without departing from the spirit and scope of the invention defined in the attached claims.

What is claimed is:

1. A method of refilling an ink cartridge with ink, the ink cartridge to be mounted on a main body of a recording apparatus and including: a casing in which is formed an ink chamber for accommodating ink; and two valve members which are disposed on one side of the casing and which are biased, in an ordinary state, in a direction to respectively close one and the other of an air-introduce passage and an ink-supply passage through which the ink chamber communicates with an exterior of the ink cartridge, the two valve members being arranged to be placed in an open state when the ink cartridge is mounted on the main body of the recording apparatus; and a cover member being fixed to the one side of the casing for holding the two valve members between the cover member and the casing, the method of refilling comprising the steps of:

forming, at a portion of the casing except for the one side thereof on which the two valve members are disposed, an opening through which the ink chamber and the exterior of the ink cartridge communicate with each other; and refilling the ink cartridge with ink by introducing the ink into the ink chamber through the opening;

wherein the forming an opening comprises forming the opening at the portion of the casing except for the one side thereof to which the cover member is fixed, such that the cover member holds the two valve members between the cover member and the casing;

wherein the portion of the casing except for the one side thereof on which the two valve members are disposed is located on another side of the casing which is opposite to the one side; and wherein the one side of the casing is located at a lower part of the ink cartridge while the another side is located at an upper part of the ink cartridge, when the ink cartridge is mounted on the main body of the recording apparatus.

2. The method of refilling according to claim 1, wherein air is introduced into the ink chamber through the air-introduce passage and the ink in the ink chamber is supplied into the main body of the recording apparatus through the ink-supply passage.

3. The method of refilling according to claim 1, further comprising fluid-tightly closing the opening after the ink cartridge has been filled with the ink.

4. The method of refilling according to claim 3, wherein the fluid-tightly closing the opening comprises fitting a plug in the opening.

5. The method of refilling according to claim 4, wherein the plug includes a shaft portion and end portions which are respectively formed at opposite ends of the shaft portion, and the end portions are brought into close contact respectively with opposite surfaces of a wall which constitutes the portion of the casing except for the one side thereof, when the plug is fitted in the opening.

6. The method of refilling according to claim 4, wherein the plug is formed of an elastic body.

7. The method of refilling according to claim 1, wherein the opening is formed in a flat surface.

8. The method of refilling according to claim 1, wherein the forming an opening is carried out by using a commercially available tool.

9. The method of refilling according to claim 1, wherein the forming an opening is carried out by using a drill.

10. The method of refilling according to claim 1, wherein the filling the ink cartridge is carried out by using an ink-injector which includes a flexible container portion accommodating ink therein and a nozzle portion and which is arranged such that the container portion is compressed for injecting the ink into the ink chamber through the nozzle portion.

11. The method of refilling according to claim 10, wherein the nozzle portion has a size at a leading end thereof which is not larger than a size of the opening.

12. The method of refilling according to claim 1, wherein the casing is formed of a material which is transparent or translucent, and the filling the ink cartridge is carried out while visually checking an amount of the ink introduced into the ink chamber.

13. The method of refilling according to claim 1, further comprising:

forming, at the portion of the casing except for the one side thereof on which the two valve members are disposed, a second opening which is different from the opening as a first opening, wherein filling the ink cartridge is carried out while discharging air out of the ink chamber to the exterior through the second opening.

14. The method of refilling according to claim 13, wherein the first opening and the second opening are located on the same plane.

15. The method of refilling according to claim 1, wherein said method is performed on a cartridge that has not been previously refilled.

16. The method of refilling according to claim 1, wherein said method is performed on a cartridge that has been previously refilled.

* * * * *